US006816698B2

(12) United States Patent
Morihara

(10) Patent No.: US 6,816,698 B2
(45) Date of Patent: Nov. 9, 2004

(54) FIXING APPARATUS WITH RESONANT CIRCUIT FOR IMAGE FORMING APPARATUS

(75) Inventor: Kazushige Morihara, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/457,460

(22) Filed: Jun. 10, 2003

(65) Prior Publication Data

US 2003/0228178 A1 Dec. 11, 2003

(30) Foreign Application Priority Data

Jun. 11, 2002 (JP) ..... 2002-170011

(51) Int. Cl.[7] ..... G03G 15/20
(52) U.S. Cl. ..... 399/328; 219/216
(58) Field of Search ..... 399/328, 320; 219/216

(56) References Cited

U.S. PATENT DOCUMENTS

2003/0053812 A1 3/2003 Nakayama

*Primary Examiner*—Quana Grainger
(74) *Attorney, Agent, or Firm*—Foley & Lardner LLP

(57) ABSTRACT

A fixing apparatus comprising a heating roller, a coil provided in the heating roller and configured to generate a high-frequency magnetic field, and capacitors and that constitute a resonant circuit, jointly with the coil. The resonant circuit is excited, sequentially (or alternately) at a plurality of frequencies which are nearly equal to the resonance frequency of the resonant circuit.

18 Claims, 10 Drawing Sheets

FIXING APPARATUS WITH RESONANT CIRCUIT FOR IMAGE FORMING APPARATUS

CROSS-REFERENCE TO RELATED APPLICATIONS

This application is based upon and claims the benefit of priority from the prior Japanese Patent Application No. 2002-170011, filed Jun. 11, 2002, the entire contents of which are incorporated herein by reference.

BACKGROUND OF THE INVENTION

1. Field of the Invention

The present invention relates to a fixing apparatus designed for use in an image forming apparatuses such as copiers or printers and configured to fix developer images on paper sheets.

2. Description of the Related Art

Any image forming apparatus utilizing digital technology, such as an electronic copier, comprises a document table and a photoelectric transducer such as a CCD (Charge Coupled Device). An original document is placed on the document table so that it may be copied. Light is applied to, and reflected from, the original document. The light reflected is guided to the photoelectric transducer.

The CCD generates an image signal that represents the image printed on the original document. The image signal is supplied to the laser provided in the apparatus. Driven by the signal, the laser emits a laser beam. The laser beam is applied to the photosensitive drum incorporated in the apparatus, forming an electrostatic latent image on the circumferential surface of the drum. Developer is applied to the drum, converting the latent image to a visible image known as "toner image." A paper sheet is fed to the drum as the drum is rotated. The toner image is transferred to the paper sheet. The paper sheet, now having the toner image on it, is fed to the fixing apparatus provided in the image-forming apparatus.

The fixing apparatus comprises a heating roller and a pressing roller. The pressing roller contacts the heating roller. It rotates together with the heating roller, applying a pressure onto the heating roller. The paper sheet is fed forward through the nip between the heating roller and the pressing roller. As the sheet is fed so, the toner image is fixed on the paper sheet by virtue of the heat generated by the heating roller.

The heat of the heating roller is generated induction heating. The induction heating is performed by a resonant circuit that comprises a coil contained in the heating roller and a capacitor connected to the coil. The resonant circuit is excited at a frequency, passing a high-frequency current through the coil. The coil generates a high-frequency magnetic field, which induces an eddy current. The eddy current brings forth Joule heat, which heats the heating roller.

The resonant circuit has a specific resonance frequency that is determined by the inductance of the coil and the electrostatic capacitance of the capacitor. The resonance frequency may be, for example, 2 MHz. In this case, the output power of the resonant circuit may reach, for example, 1500 W.

Any fixing apparatus that comprises a resonant circuit of such a high resonance frequency and such a large output power is undesirable in view of EMI (Electromagnetic Interference). That is, the high-frequency magnetic field emanating from the coil provided in the resonant circuit adversely influences the other components and devices incorporated in the fixing apparatus.

BRIEF SUMMARY OF THE INVENTION

The present invention has been made in view of the foregoing. An object of the invention is to provide a fixing apparatus that solves the problems specified above, thus being practically useful and excelling in reliability.

A fixing apparatus according to this invention comprises: a heating roller; at least one coil provided in the heating roller and configured to generate a high-frequency magnetic field; at least one capacitor which constitute a resonant circuit, jointly with the coil; and a control unit which excites the resonant circuit, sequentially at a plurality of frequencies which are nearly equal to a resonance frequency of the resonant circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

First Embodiment

The first embodiment of the present invention will be described, with reference to the accompanying drawing.

Figure 2:
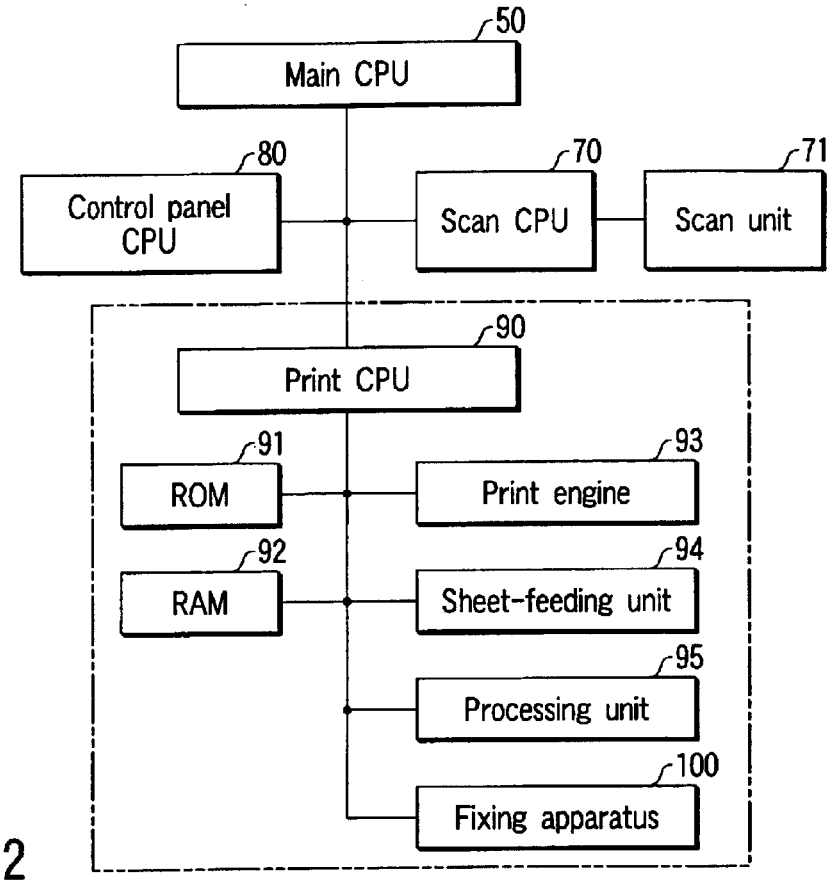
FIG. 2 is a block diagram of the control circuit incorporated in the embodiments.

FIG. 2 shows an image forming apparatus according to the first embodiment. As illustrated in FIG. 2, the image forming apparatus comprises a scanning unit 71, a processing unit 95, and a fixing apparatus 100. The scanning unit 71 optically reads the image printed on an original document. The processing unit 95 forms, on a paper sheet, a toner image corresponding to the image read by the scanning unit. The fixing apparatus 100 heats the paper sheet, thereby fixing the toner image on the paper sheet. The structure of this image forming apparatus is disclosed in U.S. patent application Ser. No. 09/955,089 and will not be described in detail.

Figure 1:
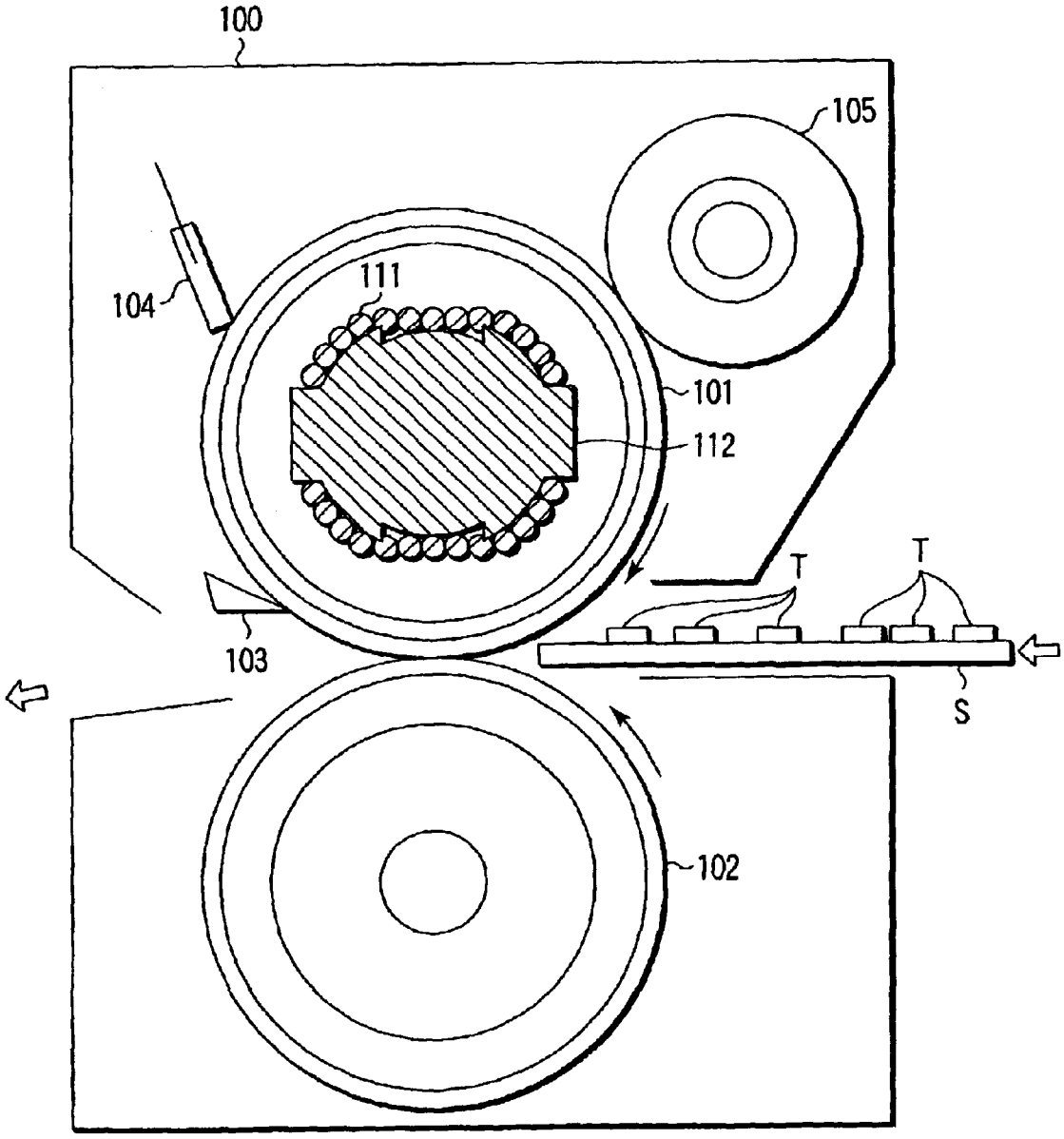
FIG. 1 shows the structure common to the first and second embodiments of the present invention.

FIG. 1 depicts the fixing apparatus 100. As shown in FIG. 1, the fixing apparatus 100 comprises a heating roller 101 and a pressing roller 102. The heating roller 101 is located above the copy-sheet S path. The pressing roller 102 lies below the copy-sheet S path and contacts the heating roller 101, pressed onto the roller 101 by means of a pressing mechanism (not shown). The contacting parts of the rollers 101 and 102 form a nip. The nip has a prescribed length.

The heating roller 101 comprises a hollow cylinder and a layer. The cylinder is made of electrically conductive material, for example iron. The layer is made of, for example, Teflon, and covers the outer circumferential surface of the hollow cylinder. The heating roller 101 can be rotated clockwise in FIG. 1. A copy sheet S may pass through the nip between the heating roller 101 and the pressing roller 102. While passing through the nip, the sheet S receives heat from the heating roller 101. The toner image T on the sheet S is thereby fixed.

A sheet-peeling claw 103, a cleaning member 104, and a release-agent applying roller 105 are arranged around the heating roller 101. The sheet-peeling claw 103 is designed to peel a copy sheet S from the heating roller 101. The cleaning member 104 is configured to remove residual toner, paper dust and the like from the heating roller 101. The release-agent applying roller 105 is provided to apply a release agent to the outer circumferential surface of the heating roller 101.

The heating roller 101 incorporates a coil 111 that performs induction heating. The coil 111 is wound and held around a core 112. It is designed to generate a high-frequency magnetic field to achieve induction heating. When the coil 111 generates a high-frequency magnetic field, an eddy current is induced in the heating roller 101. The roller 101 generates Joule heat from the eddy current.

The control circuit incorporated in the image forming apparatus is shown in FIG. 2. As FIG. 2 shows, the control circuit comprises a main CPU 50, a scan CPU 70, a control-panel CPU 80, and a print CPU 90. The CPUs 70, 80 and 90 are connected to the main CPU 50. The main CPU 50 controls the scan CPU 70, control-panel CPU 80 and print CPU 90. Note that the scanning unit 71 is connected to the scan CPU 70.

A ROM 91, a RAM 92, a print engine 93, a sheet-feeding unit 94, a processing unit 95, and the fixing apparatus 100 are connected to the print CPU 90. The ROM 91 stores control programs. The RAM 92 is provided to store data.

Figure 3:
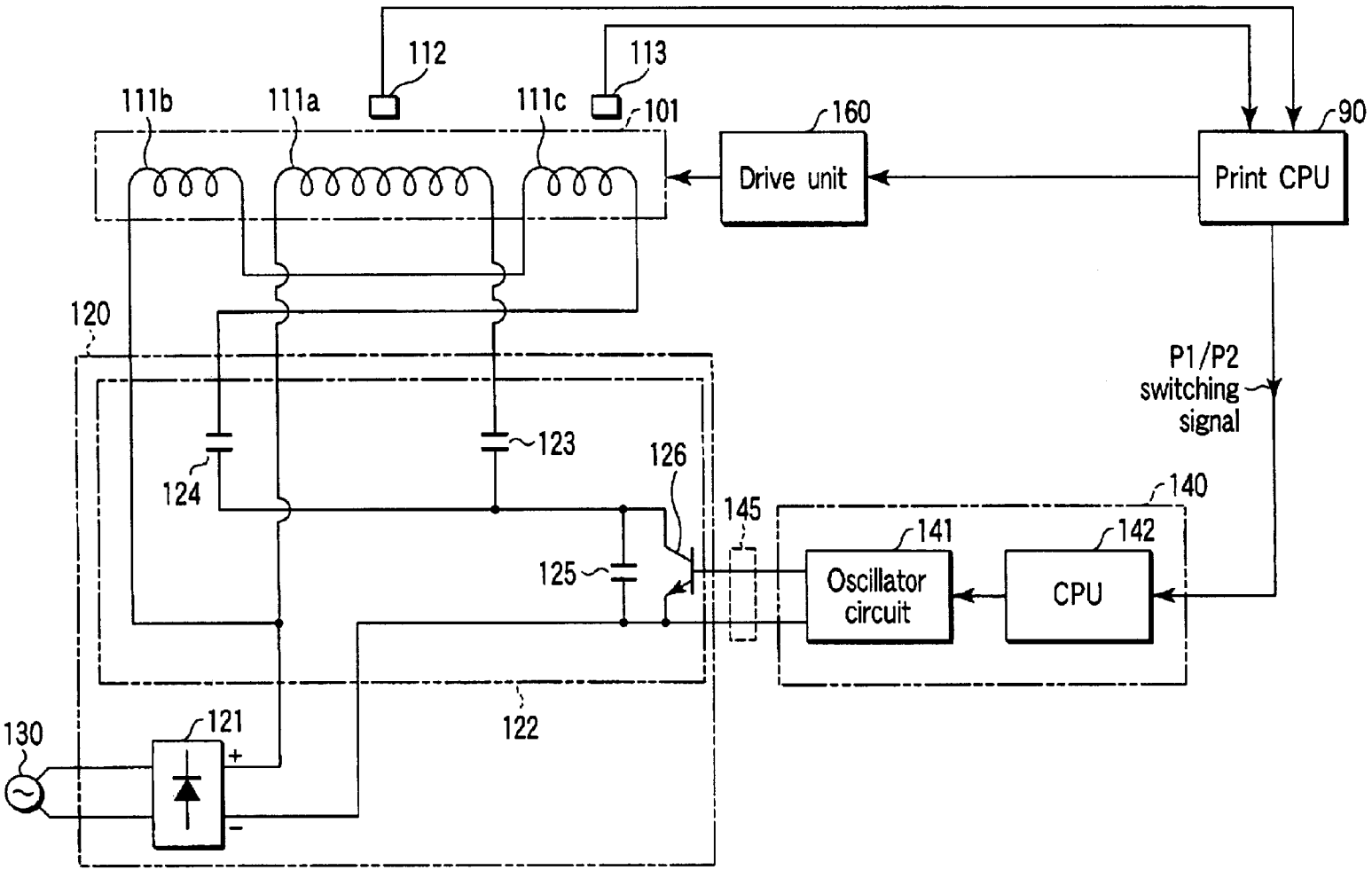
FIG. 3 is a block diagram of the electric circuit provided in the first embodiment.

FIG. 3 depicts the electric circuit of the fixing apparatus 100. The coil 111 provided in the heating roller 101 is composed of three coils 111*a*, 111*b* and 111*c*. The coil 111*a* is located in the middle part of the heating roller 101. The coil 111*b* lie on one end of the coil 111*a*, and the coil 111*c* at the other end of the coil 111*a*. Three coils 111*a*, 111*b* and 111*c* are used to fix a toner image on a large paper sheet S. Only the coil 111*a* is used to fix a toner image on a small paper sheet S. The coils 111*a*, 111*b* and 111*c* are connected to a high-frequency power generating circuit 120.

A temperature sensor 112 is provided to detect the temperature of the middle part of the heating roller 101. Another temperature sensor 113 is provided to detect the temperature of one end part of the heating roller 101. Both temperature sensors 112 and 113 are connected to the print CPU 90. A drive unit 160 for driving the heating roller 101 is connected to the print CPU 90, too.

The print CPU 90 performs several functions. Its first function is to control the drive unit 160. Its second function is to generate a P1/P2 switching signal that selects either a first serial resonant circuit (later described) or a second serial resonant circuit (later described). Its third function is to control the output powers P1 of the first and second serial resonant circuits in accordance with the temperatures detected by the temperature sensors 112 and 113. The first serial resonant circuit includes the coil 111*a*. The second serial resonant circuit includes the coils 111*b* and 111*c*.

The high-frequency power generating circuit 120 generates high-frequency power from which a high-frequency magnetic field may be generated. The circuit 120 comprises a rectifying circuit 121 and a switching circuit 122. The switching circuit 122 is connected to the output of the rectifying circuit 121. The rectifying circuit 121 rectifies the AC voltage applied from a commercially available power supply 130. The switching circuit 122 comprises three capacitors 123, 124 and 125 and a transistor 126. The capacitors 123 and 125 constitute the first serial resonant circuit, jointly with the coil 111*a*. The capacitors 124 and 125 constitute the second serial resonant circuit, jointly with the series circuit composed of the coils 111*b* and 111*c*. The transistor 126, which is, for example, a FET, excites either the first serial resonant circuit or the second serial resonant circuit, or both.

The first serial resonant circuit has resonance frequency f1 that is determined by an inductance L1 of the coil 111*a*, the electrostatic capacitance C1 of the capacitor 123 and the electrostatic capacitance C3 of the capacitor 125.

The second serial resonant circuit has resonance frequency f2 that is determined by the total inductance L2 of the coils 111*b* and 111*c*, the electrostatic capacitance C2 of the capacitor 124 and the electrostatic capacitance C3 of the capacitor 125.

The P1/P2 switching signal is supplied from the print CPU 90 to a controller 140. In accordance with the signal, the controller 140 drives the transistor 126. The controller 140 comprises an oscillator circuit 141 and a CPU 142. The oscillator circuit 141 generates a drive signal having a prescribed frequency. The drive signal is supplied to the transistor 126.

The CPU 142 controls the resonance frequency of the oscillator circuit 141. It has the following means (1) and (2):

(1) Control means for exciting the first serial resonant circuit, sequentially (or alternately) at different frequencies (e.g., $f1-\Delta f$) and ($f1+\Delta f$) that are nearly equal to the resonance frequency f1, if the P1/P2 switching signal supplied from the print CPU 90 selects the first serial resonant circuit (that is, if only the coil 111*a* is used).

(2) Control means for exciting the first serial resonant circuit, sequentially at different frequencies (e.g., f1−Δf) and (f1+Δf) that are nearly equal to the resonance frequency f1, and for exciting the second serial resonant circuit at different frequencies (e.g., f2−Δf) and (f2+Δf) that are nearly equal to the resonance frequency f2, if the P1/P2 switching signal supplied from the print CPU 90 selects the first and second serial resonant circuits (that is, if all coils 111*a*, 111*b* and 111*c* are used).

How the fixing apparatus 100 operates will be described below.

The oscillator circuit 141 generates a drive signal that has a frequency equal to (or nearly equal to) the resonance frequency f1 of the first serial resonant circuit. The drive signal turns the transistor 126 on and off, exciting the first serial resonant circuit. As a result, the coil 111*a* generates a high-frequency magnetic field. The magnetic field induces an eddy current in that part of the heating roller 101, which is middle with respect to the axial direction of the roller 101. Joule heat is generated from the eddy current, in the middle part of the heating roller 101.

The oscillator circuit 141 generates a drive signal that has a frequency equal to (or nearly equal to) the resonance frequency f2 of the second serial resonant circuit. This drive signal turns the transistor 126 on and off, too, exciting the second serial resonant circuit. In this case, the coils 111*b* and 11*c* generate two high-frequency magnetic fields, respectively. The first magnetic field induces an eddy current in one end part of the heating roller 101. The second magnetic field induces an eddy current in the other end part of the roller 101. Thus, Joule heat is generated from the eddy currents, in both end parts of the heating roller 101.

Figure 4:
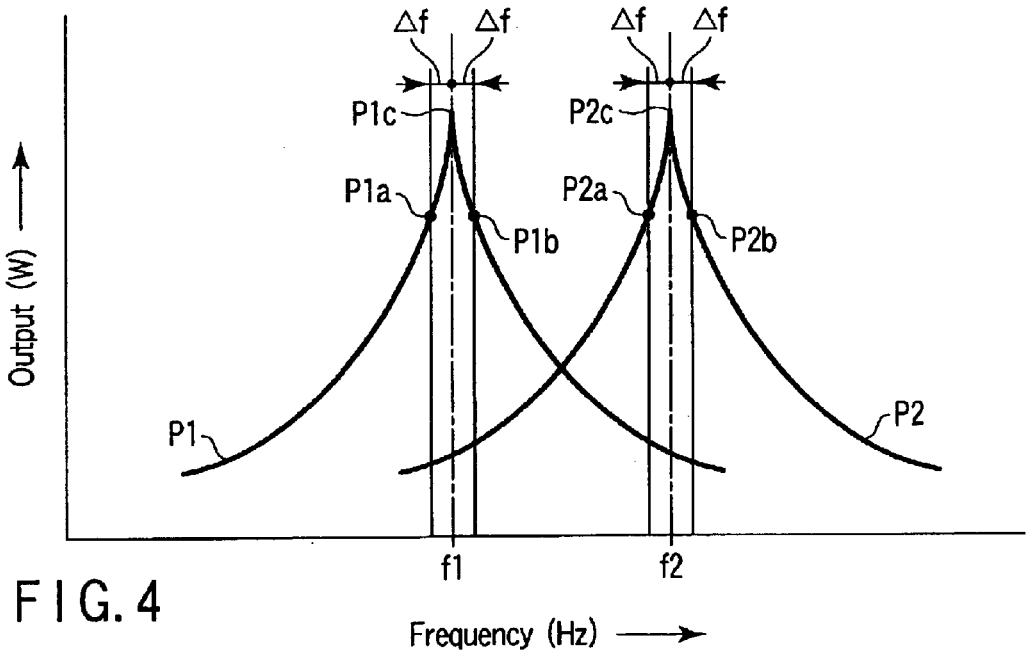
FIG. 4 is a graph representing the relation between the output power of each serial resonant circuit provided in the embodiments and the excitation frequency of the serial resonant circuit.

FIG. 4 illustrates the relation between the output power P1 of the first serial resonant circuit and the excitation frequency of the first serial resonant circuit, and also the relation between the output power P2 of the second serial resonant circuit and the excitation frequency of the second serial resonant circuit.

As seen from FIG. 4, the output power P1 of the first serial resonant circuit gradually increases as its excitation frequency is raised. The power P1 reaches the peak when the circuit is excited at its resonance frequency f1. As the excitation frequency is further left from the frequency f1, the power P1 gradually decreases. Similarly, the output power P2 of the second serial resonant circuit gradually increases as its excitation frequency is raised, reaches the peak when the circuit is excited at its resonance frequency f2. As the excitation frequency is further left from frequency f2, the power P2 gradually decreases.

The first and second serial resonant circuits are both excited to fix a toner image on a large paper sheet S. In this case, all coils 111*a*, 111*b* and 111*c* generate a high-frequency magnetic field each. The high-frequency magnetic fields induce an eddy current in the entire heating roller 101. The heating roller 101 generates, in its entirety, Joule heat from the eddy current.

More specifically, the oscillator circuit 141 repeatedly outputs four drive signals, each time in the order of the first, second, third and fourth drive signals. The first and second drive signals have frequencies (f1−Δf) and (f1+Δf), respectively, where f1 is the resonance frequency of the first serial resonant circuit and Δf is a preset value. The third and fourth drive signals have frequency (f2−Δf) and (f2+Δf), respectively, where f2 is the resonance frequency of the second serial resonant circuit and Δf is the preset value.

The first and second drive signals are alternately supplied to the first serial resonant circuit, repeatedly exciting the circuit, each time at frequency (f1−Δf) and then frequency (f1+Δf). The third and fourth derive signals are alternately supplied to the first serial resonant circuit, repeatedly exciting the circuit, each time at frequency (f1−Δf) and then frequency (f1+Δf).

When the first serial resonant circuit is excited at the frequency (f1−Δf), the output power P1 of the coil 111*a* provided in the circuit has a value P1*a* that is a little smaller than the peak value P1*c* as seen from FIG. 4. When the first serial resonant circuit is excited at the frequency (f1+Δf), the output power P1 of the coil 111*a* has a value P1*b* that is slightly smaller than the peak value P1*c*, as seen from FIG. 4.

When the second serial resonant circuit is excited at the frequency (f1−Δf), the output power P2 of the coils 111*b* and 111*c* provided in the circuit have a value P2*a* that is a little smaller than the peak value P2*c* as seen from FIG. 4. When the second serial resonant circuit is excited at the frequency (f1+Δf), the output power P2 of the coils 111*b* and 111*c* have a value P2*b* that is slightly smaller than the peak value P1*c*, as seen from FIG. 4.

Figure 5:
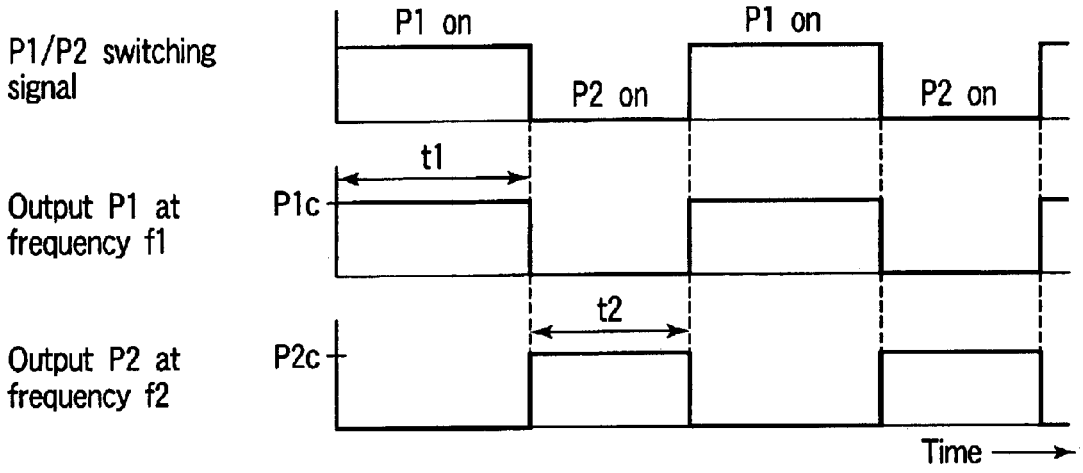
FIG. 5 is a chart showing how the output powers change as the excitation frequency is varied in the conventional fixing apparatus.
Figure 6:
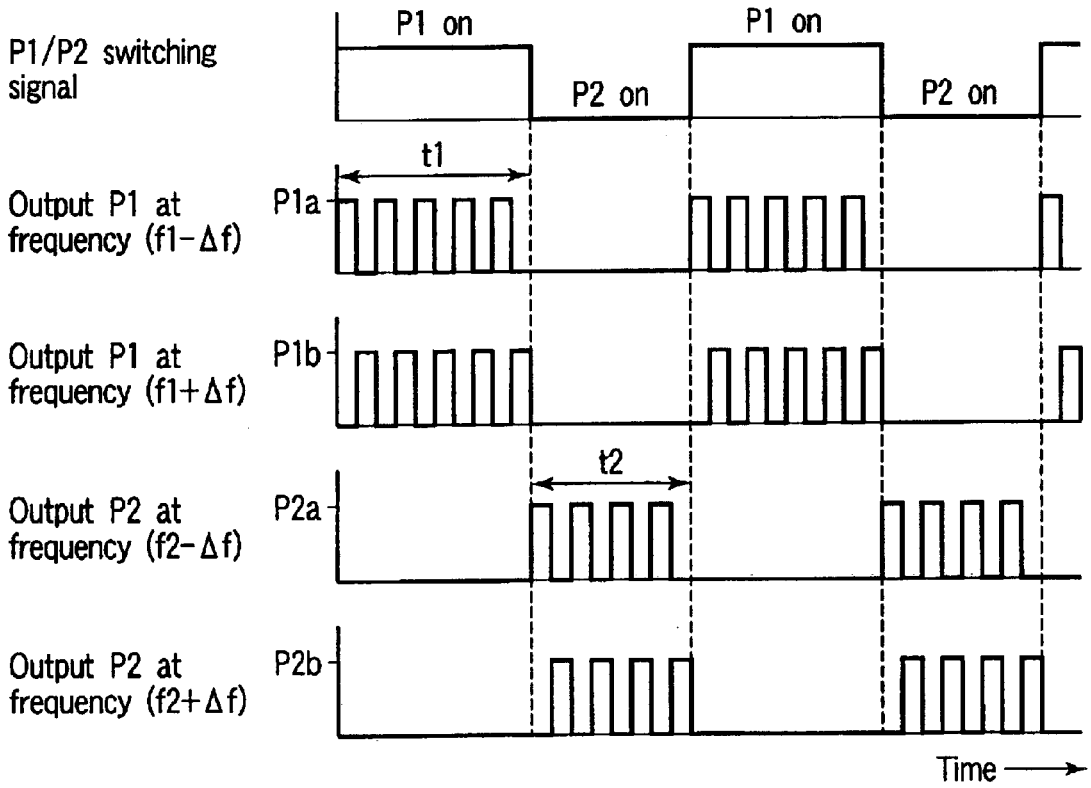
FIG. 6 is a chart illustrating how the output powers change as the excitation frequency is varied in each embodiment of the present invention.

FIG. 5 shows how the output powers P1 and P2 change to values P1*a*, P1*b*, P2*a*, P2*b*, P1*c* and P2*c* as the excitation frequency is varied in the conventional fixing apparatus. FIG. 6 shows how the output powers P1 and P2 change to values P1*a*, P1*b*, P2*a*, P2*b*, P1*c* and P2*c* as the excitation frequency is varied in the present embodiment of this invention.

In the conventional fixing apparatus, the resonant circuit is excited at frequency f1 to output power P1*c*, while the P1/P2 switching signal remains at P1 level, and excited at frequency f2 to output power P2*c*, while the P1/P2 switching signal remains at P2 level. Consequently, the EMI (Electromagnetic Interference) level will rise.

In the present invention, the first serial resonant circuit is excited, alternately at two frequencies (f1−Δf) and (f1+Δf), to output power P1*a* and power P1*b*, while the P1/P2 switching signal remains at P1 level. Both powers P1*a* and P1*b* are almost equal to the power that the resonant circuit outputs in the conventional fixing apparatus. Namely:

$$(½)\cdot t1\cdot P1a+(½)\cdot t1\cdot P1b\approx t1\cdot P1c$$

Nonetheless, the EMI level is lower than in the conventional fixing apparatus, because the EMI is divided into two part, one for the frequency (f1−Δf) and the other for the frequency (f1+Δf).

While the P1/P2 switching signal remains at P2 level, the second serial resonant circuit is excited, alternately at two frequencies (f2−Δf) and (f2+Δf), to output power P2*a* and power P2*b*. Both powers P2*a* and P2*b* are almost equal to the power that the resonant circuit outputs in the conventional fixing apparatus, just as the first serial resonant circuit does when excited at the frequency f1.

As indicated above, the first serial resonant circuit is excited, alternately at two frequencies (f1−Δf) and (f1+Δf), whereby the output power P1 of the coil 111*a* is divided and distributed to two systems. The EMI (Electromagnetic Interference) can therefore be attenuated, not only when the first serial resonant circuit is excited at the frequency (f1−Δf) but also when it is excited at the frequency (f1+Δf).

Further, since the second serial resonant circuit is excited, alternately at two frequencies (f2−Δf) and (f2+Δf). Thus, the output power P2 of the coils 111*b* and 111*c* is divided and distributed to two systems. The EMI (Electromagnetic Interference) can therefore be attenuated, not only when the second serial resonant circuit is excited at the frequency (f2−Δf) but also when it is excited at the frequency (f2+Δf).

The attenuation of the EMI enhances the usefulness and reliability of the fixing apparatus 100.

To fix a toner image on a small paper sheet S, only the first serial resonant circuit is excited, alternately at two frequencies (f1−Δf) and (f1+Δf) that are slightly lower and higher than its resonance frequency f1. As a result, the coil 111*a* generates a high-frequency magnetic field. This magnetic field induces an eddy current in the middle part of the heating roller 101. The middle part of the roller 101 generates Joule heat from the eddy current.

As shown in FIG. 3, a frequency-modulating IC (SSIC: Split Spectrum IC) 145 may be provided on the drive-signal line that connects the oscillator circuit 141 to the transistor 126. The SSIC 145 generates two drive signals, each from one drive signal it has received from the oscillator circuit 141. The two drive signals have a frequency 0.5% lower than, and a frequency 0.5% higher than, the frequency of the input drive signal, respectively. The drive signals are alternately output from the SSIC 145.

Thanks to the use of the SSIC 145, the oscillator circuit 141 only needs to output drive signals of the same frequency, one after another. This lessens the complexity of the control that the CPU 142 must perform. Since the SSIC 145 generates two drive signals of different frequencies, the EMI level can be greatly lowered.

Figure 7:
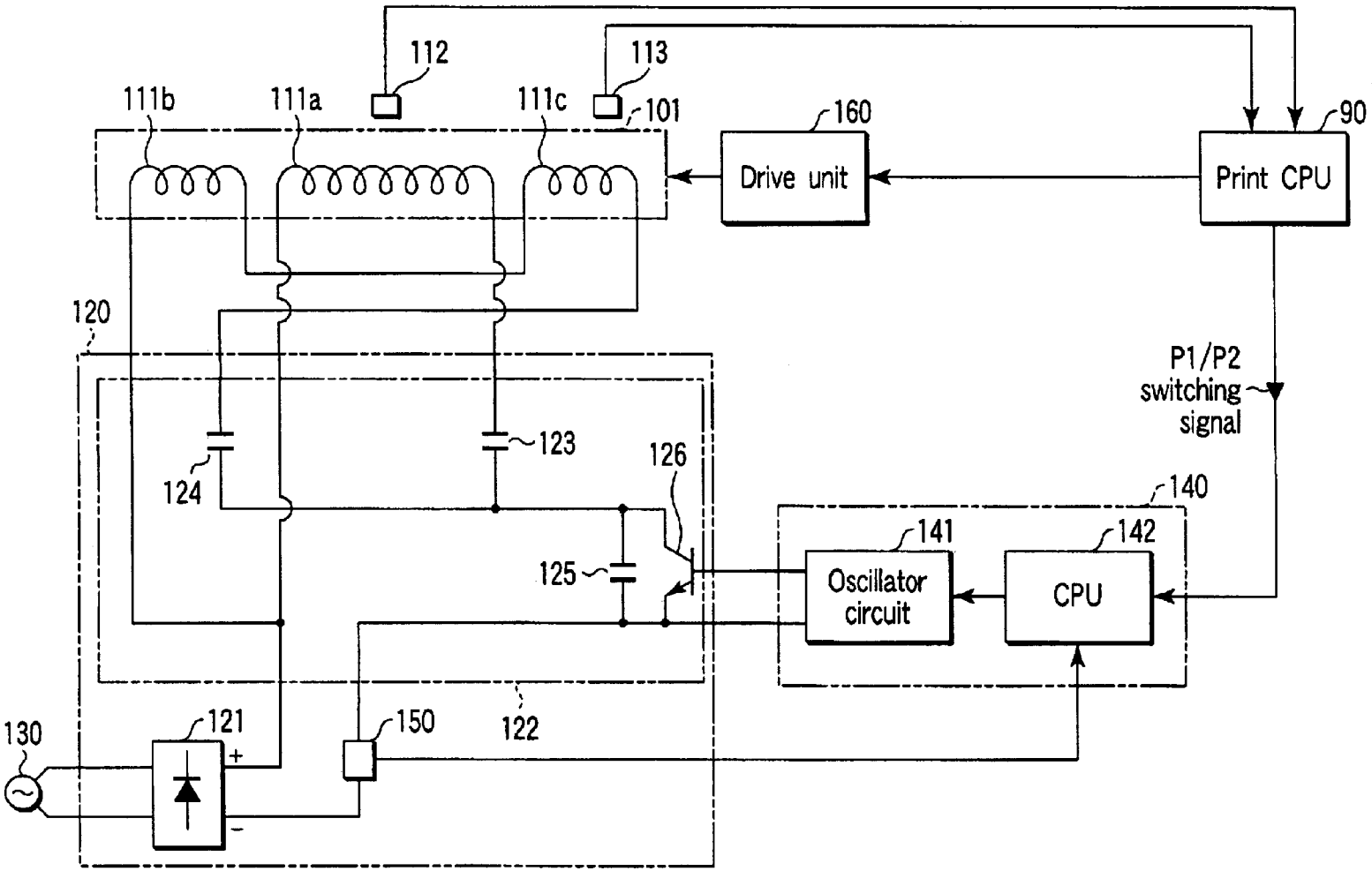
FIG. 7 is a block diagram of the electric circuit incorporated in the second embodiment.
Figure 12:
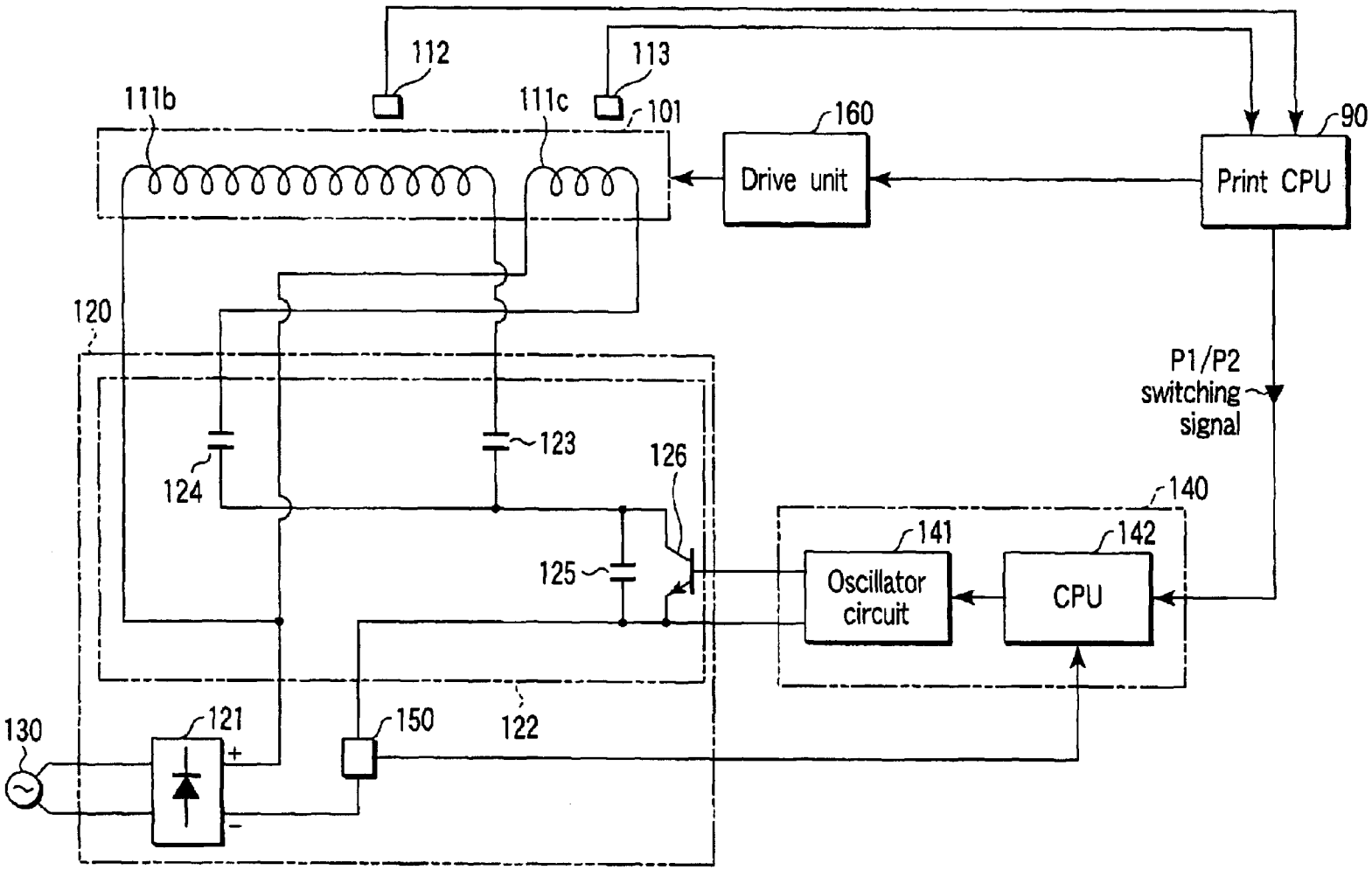
FIG. 12 is a circuit diagram of a modification of the circuit shown in FIG. 7.

The circuit of FIG. 7 is designed for the case where the sheet S is fed with its middle part contacting the middle part of the heating roller 101. All sheets S are not fed in this manner. Some sheets may be fed, each with its middle part contacting an end part of the heating roller 101. FIG. 12 shows a modification of the circuit, which is designed to fixing a toner image on a sheet that is fed with its middle part contacting an end part of the roller 101.

Second Embodiment

A fixing apparatus 100, which is the second embodiment of the invention, will be described, with reference to FIGS. 7 to 11.

As FIG. 7 depicts, a current-detecting circuit 150 is provided on the DC-supply line that connects the rectifying circuit 121 to the switching circuit 122 in the high-frequency power generating circuit 120. The current-detecting circuit 150 detects the high-frequency current (resonance current) I that flows in the switching circuit 122, or in the first and second serial resonant circuits. The circuit 150 generates a signal representing the value of the current I. The signal is supplied to the CPU 142.

The CPU 142 controls the resonance frequency. It has the following means (1) to (4):

(1) Control means for exciting the first serial resonant circuit, sequentially (or alternately) at different frequencies (e.g., f1−Δf) and (f1+Δf) that are nearly equal to the resonance frequency f1, if the first serial resonant circuit is selected in accordance with the P1/P2 switching signal supplied from the print CPU 90 (that is, if only the coil 111*a* is used).

(2) Control means for exciting the first serial resonant circuit, sequentially at different frequencies (e.g., f1−Δf) and (f1+Δf) that are nearly equal to the resonance frequency f1, and for exciting the second serial resonant circuit at different frequencies (e.g., f2−Δf) and (f2+Δf) that are nearly equal to the resonance frequency f2, if the first and second serial resonant circuits are selected in accordance with the P1/P2 switching signal supplied from the print CPU 90 (that is, if all coils 111*a*, 111*b* and 111*c* are used).

(3) Detecting means for detecting changes in the resonance frequencies f1 and f2 from the current I that the current-detecting circuit 150 has detected.

(4) Control means for change the excitation frequencies (f1−Δf), (f1+Δf), (f2−Δf) and (f2+Δf) by the same value.

The second embodiment is identical to the first embodiment in any other respects. How the second embodiment operates will be described below.

The coils 111*a*, 111*b* and 111*c* and the capacitors 123, 124 and 125 have temperature-dependency. Thus, the resonance frequency f1 of the first serial resonant circuit and the resonance frequency f2 of the second serial resonant circuit may change as illustrated in FIG. 8 or in FIG. 9.

Figure 8:
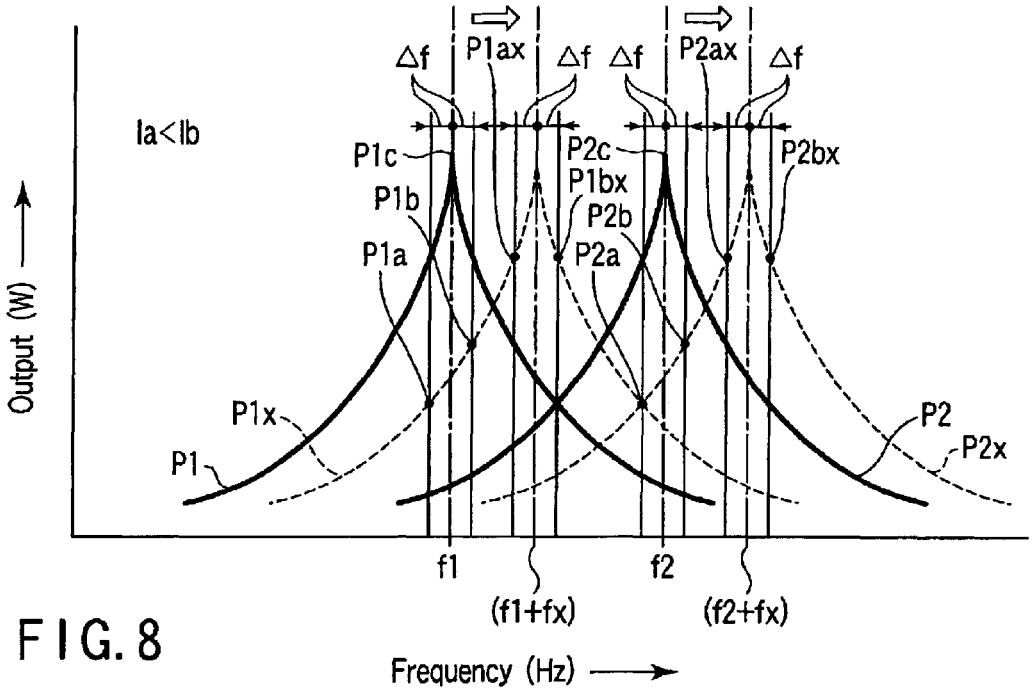
FIG. 8 is a graph illustrating how the second embodiment operates.

In the case shown in FIG. 8, the resonance frequencies f1 and f2 increase to (f1+Δf) and (f2+Δf), respectively, as indicated by the broken lines. Hence, the output power P1 of the first serial resonant circuit will have value P1*a* when the resonant circuit is excited at frequency (f1−Δf) and will have value P1*b* when the resonant circuit is excited at frequency (f1+Δf), if the excitation frequencies remain at (f1−Δf) and (f1+Δf). The value P1*a* is considerably smaller than the peak value. The value P1*b* is smaller than the peak value, too, though it is greater than the value P1*a*. Consequently, induction heating is performed but at low-efficiency. Similarly, the output power P2 of the second serial resonant circuit will have value P2*a* when the resonant circuit is excited at frequency (f2−Δf) and will have value P2*b* when the resonant circuit is excited at frequency (f2+Δf), if the excitation frequencies remain at (f2−Δf) and (f2+Δf). The value P2*a* is considerably smaller than the peak value. The value P2*b* is smaller than the peak value, too, though it is greater than the value P2*a*. Inevitably, induction heating will be performed but at low efficiency.

Figure 9:
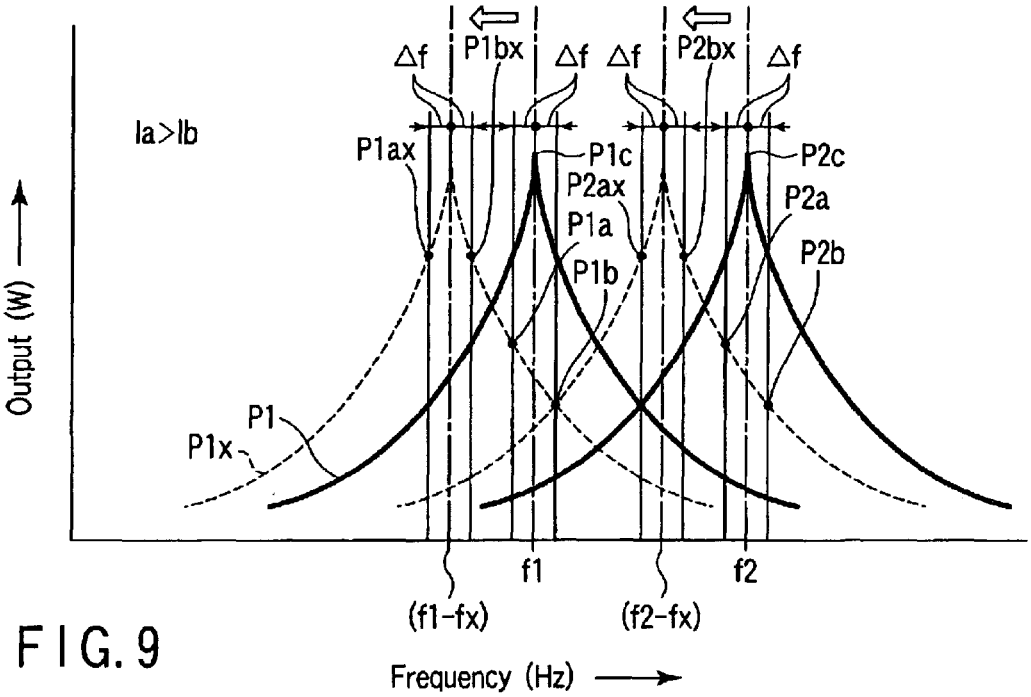
FIG. 9 is a graph illustrating how the second embodiment operates.
Figure 10:
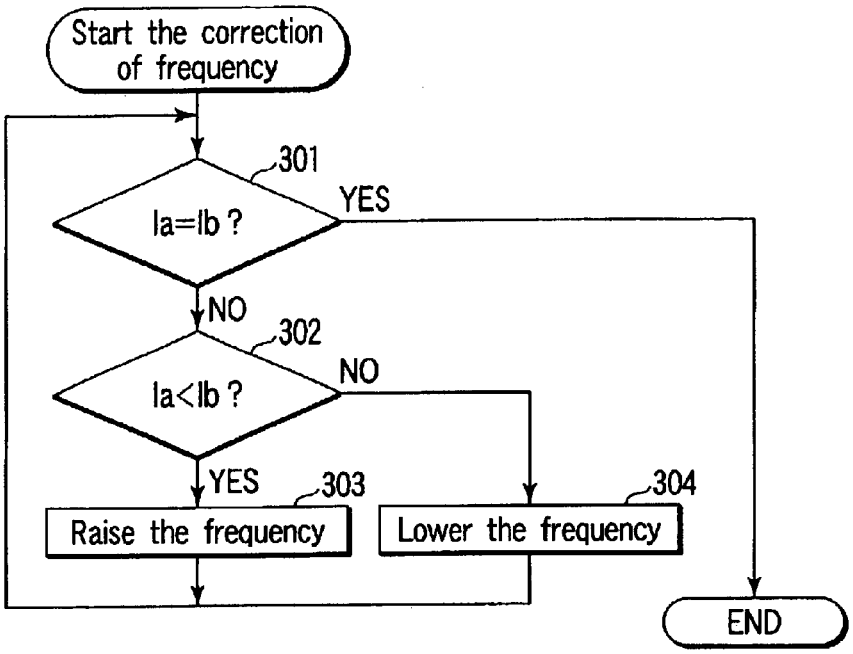
FIG. 10 is a flowchart explaining how frequency correction is carried out in the second embodiment.

In the case shown in FIG. 9, the resonance frequencies f1 and f2 decrease to (f1−Δf) and (f2−Δf), respectively, as indicated by the broken lines. Hence, the output power P1 of the first serial resonant circuit will have value P1*a* when the resonant circuit is excited at frequency (f1−Δf) and will have value P1*b* when the resonant circuit is excited at frequency (f1−Δf), if the excitation frequencies remain at (f1−Δf) and (f1+Δf). The value P1*a* is considerably smaller than the peak value. The value P1*b* is still smaller than the peak value. As a consequence, induction heating will be performed but at low-efficiency. Similarly, the output power P2 of the second serial resonant circuit will have value P2*a* when the resonant circuit is excited at frequency (f2−Δf) and will have value P2*b* when the resonant circuit is excited at frequency (f2+Δf), if the excitation frequencies remain at (f2−Δf) and (f2+Δf). The value P2*a* is considerably smaller than the peak value. The value P2*b* is much smaller than the peak value. Inevitably, induction heating will be performed but at low efficiency.

In the second embodiment, the current Ia that the current-detecting circuit 150 detects while the first serial resonant circuit is being excited at frequency (f1−Δf) is compared with the current Ib that the circuit 150 detects while the first serial resonant circuit is being excited at frequency (f1+Δf). The currents Ia and Ib are proportional to the output power P1*a* and P1*b*, respectively.

When the resonance frequencies f1 and f1 increase to (f1+Δf) and (f2+Δf) as illustrated in FIG. 8, P1*a*<P1*b* and, hence, Ia<Ib. In this case, the excitation frequencies (f1−Δf), (f1+Δf), (f2−Δf) and (f2+Δf) are increased by a prescribed value fx', for example 5 Hz, to (f1+fx'−Δf), (f1+fx'+Δf), (f2+fx'−Δf) and (f2+fx'+Δf), respectively. That is, if Ia<Ib (if NO in Step 301, and YES in Step 302), the excitation frequencies are increased by fx' (Step 303).

The excitation frequencies are repeatedly changed in accordance with the current the current-detecting circuit 150 has detected. Thus, as shown in FIG. 8, the output power P1 of the first serial resonant circuit has value P1ax that is slightly smaller than the peak value P1*c* when the first serial resonant circuit is excited at frequency (f1+fx'−Δf), and has value P1bx that is slightly smaller than the peak value P1*c* when the first serial resonant circuit is excited at (f1+fx'+Δf). As FIG. 8 shows, too, the output power P2 of the second serial resonant circuit has value P2ax that is a slightly smaller than the peak value P2*c* when the second serial resonant circuit is excited at frequency (f2+fx'−Δf), and has value P2bx that is slightly smaller than the peak value P2*c* when the first serial resonant circuit is excited at (f2+fx'+Δf).

Hence, efficient induction heating can be accomplished even if the resonance frequencies f1 and f2 of the resonant circuits change due to the temperature-dependency of the coils and capacitors incorporated in either resonant circuit.

The resonance frequencies f1 and f1 may decrease to (f1−Δf) and (f2−Δf) as illustrated in FIG. 9, P1*a*>P1*b* and, hence, Ia>Ib. If this is the case, the excitation frequencies (f1−Δf), (f1+Δf), (f2−Δf) and (f2+Δf) are decreased by a prescribed value fx', for example 5 Hz, to (f1−fx'−Δf), (f1−fx'+Δf), (f2−fx'−Δf) and (f2−fx'+Δf), respectively. That is, if Ia>Ib (if NO in Step 301, and NO in Step 302), the excitation frequencies are decreased by fx' (Step 304).

The excitation frequencies are repeatedly changed in accordance with the current the current-detecting circuit 150 has detected. Thus, as shown in FIG. 9, the output power P1 of the first serial resonant circuit has value P1ax that is slightly smaller than the peak value P1*c* when the first serial resonant circuit is excited at frequency (f1−fx'−Δf), and has value P1bx that is slightly smaller than the peak value P1*c* when the first serial resonant circuit is excited at (f1−fx'+Δf). As FIG. 9 shows, too, the output power P2 of the second serial resonant circuit has value P2ax that is a slightly smaller than the peak value P2*c* when the second serial resonant circuit is excited at frequency (f2−fx'−Δf), and has value P2bx that is slightly smaller than the peak value P2*c* when the first serial resonant circuit is excited at (f2−fx'+Δf).

In this case, too, efficient induction heating can be accomplished even if the resonance frequencies f1 and f2 of the resonant circuits change due to the temperature-dependency of the coils and capacitors incorporated in either resonant circuit.

The second embodiment is identical to the first embodiment in advantage and other functions.

Figure 11:
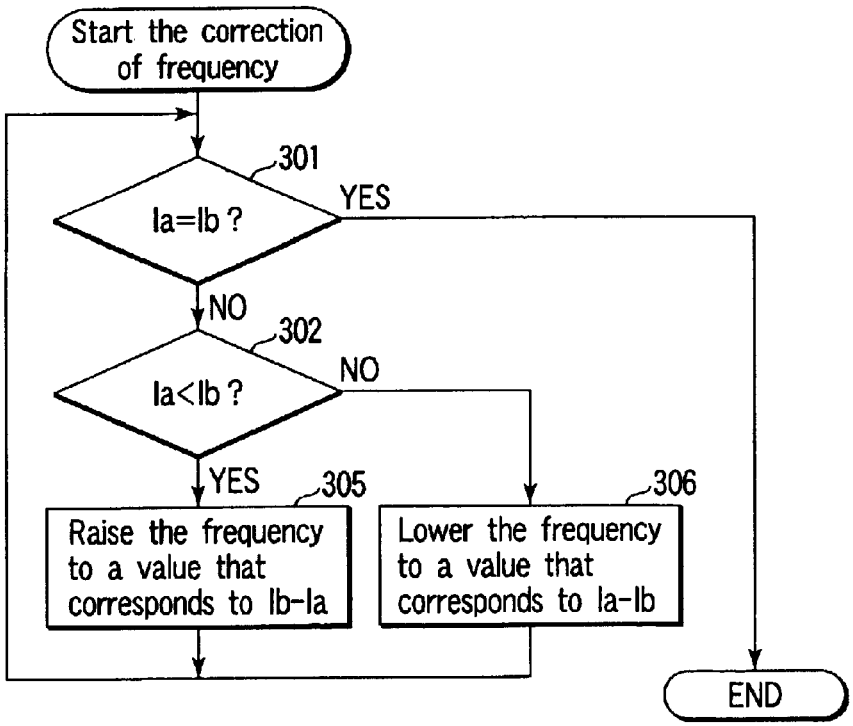
FIG. 11 is a flowchart explaining how modified frequency correction is performed in the second embodiment.

How the excitation frequency is corrected will be described with reference to the flowchart of FIG. 11. As FIG. 11 shows, the excitation frequency is raised by a value that corresponds to (or is proportional) to the difference Ic (=Ib−Ia) between the currents Ib and Ia (Step S305), when Ia<Ib (that is, if NO in Step 301, and YES in Step 302). When Ia>Ib (if NO in Step 301, and NO in Step 302), the excitation frequency is lowered by a value that corresponds (or is proportional) to the difference Ic (=Ia−Ib) between the currents Ia and Ib.

In the second embodiment, too, a frequency-modulating IC (SSIC: Split Spectrum IC) 145 may be provided on the drive-signal line that connects the oscillator circuit 141 to the transistor 126.

Third Embodiment

The third embodiment of the invention will be described.

Figure 13:
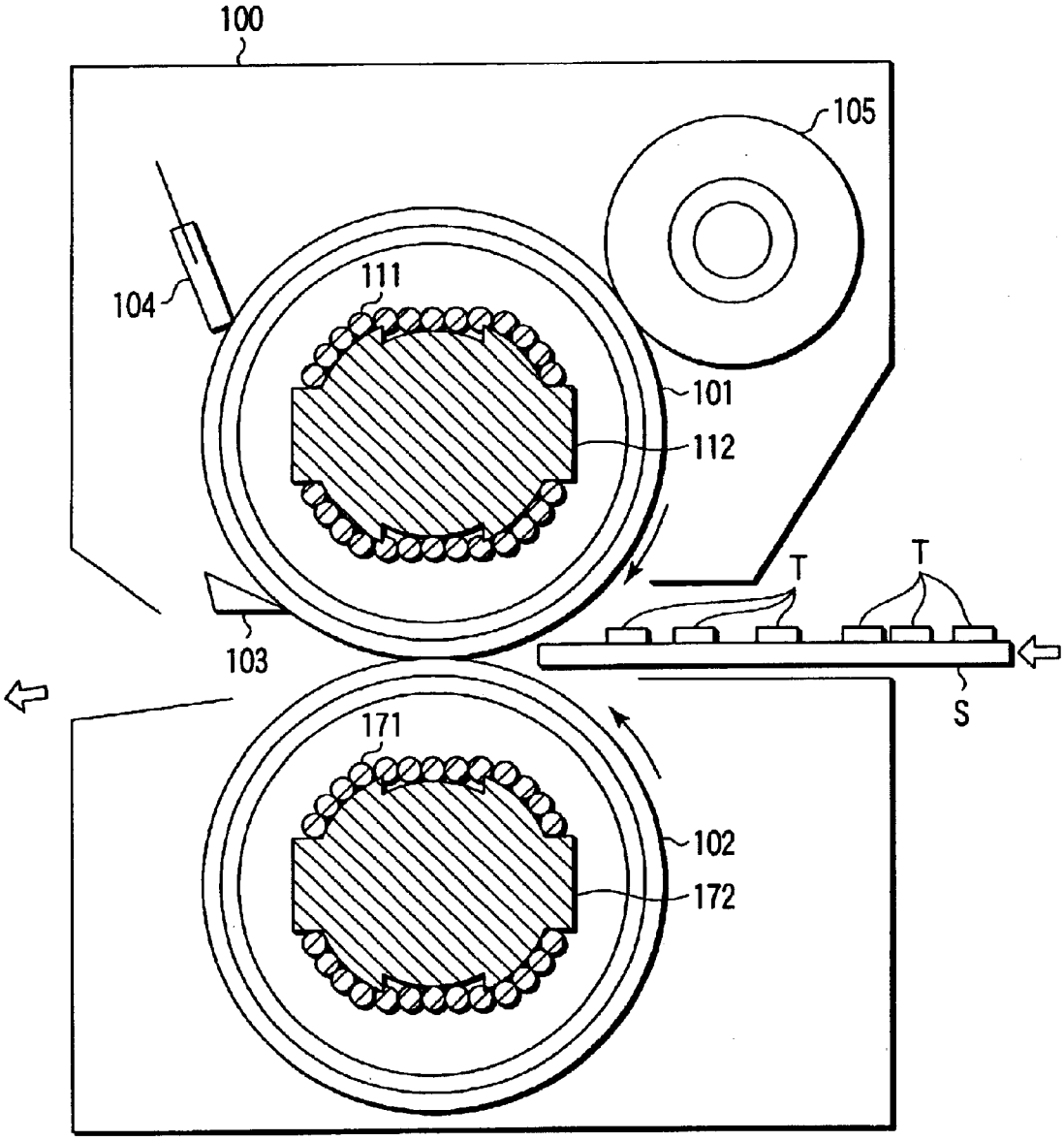
FIG. 13 depicts the structure of the third embodiment of the invention.

As FIG. 13 shows, the pressing roller 102 incorporates a coil 171 that performs induction heating. The coil 171 is wound and held around a core 172. It is designed to generate a high-frequency magnetic field to achieve induction heating. Like the heating roller 101, the pressing roller 102 comprises a hollow cylinder and a layer. The cylinder is made of electrically conductive material, for example iron. The layer is made of, for example, Teflon, and covers the outer circumferential surface of the hollow cylinder. When the coil 171 generates a high-frequency magnetic field, an eddy current is induced in the pressing roller 102. The pressing roller 102 generates Joule heat from the eddy current.

Figure 14:
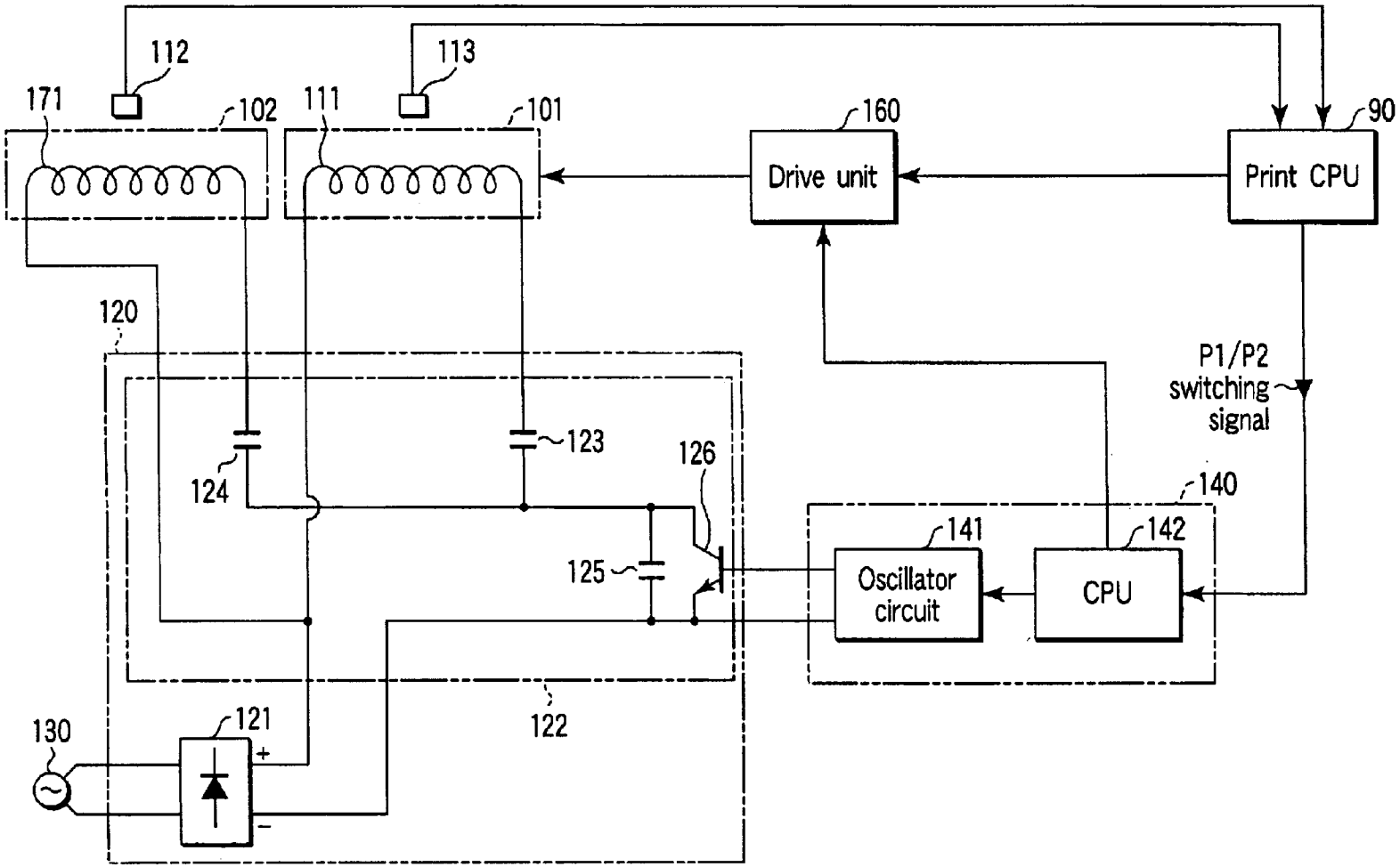
FIG. 14 is a block diagram of the electric circuit provided in the third embodiment.

FIG. 14 illustrates the electric circuit of the fixing apparatus 100. The heating roller 101 incorporates a coil 111. The coil 111 and the coil 1721 provided in the pressing roller 102 are connected to the high-frequency power generating circuit 120.

The high-frequency power generating circuit 120 generates high-frequency power from which a high-frequency magnetic field may be generated. The circuit 120 comprises a rectifying circuit 121 and a switching circuit 122. The switching circuit 122 is connected to the output of the rectifying circuit 121. The rectifying circuit 121 rectifies the AC voltage applied from a commercially available power supply 130. The switching circuit 122 comprises three capacitors 123, 124 and 125 and a transistor 126. The capacitors 123 and 125 constitute a first serial resonant circuit, jointly with the coil 111. (The coil 11 is equivalent to the coil 111*a* used in the first embodiment.) The capacitors 124 and 125 constitute a second serial resonant circuit, jointly with the coil 171. (The coil 171 is equivalent to the coils 111*b* and 111*b* used in the first embodiment.) The transistor 126, which is, for example, a FET, excites either the first serial resonant circuit or the second serial resonant circuit, or both. The transistor 126, for example a FET, drives either the first serial resonant circuit or the second serial resonant circuit.

The first serial resonant circuit has resonance frequency f1 that is determined by the inductance L1 of the coil 111, the electrostatic capacitance C1 of the capacitor 123 and the electrostatic capacitance C3 of the capacitor 125.

The second serial resonant circuit has resonance frequency f2 that is determined by the inductance L2 of the coil 171, the electrostatic capacitance C2 of the capacitor 124 and the electrostatic capacitance C3 of the capacitor 125.

The transistor 126 is tuned on or off by a controller 140. The controller 140 comprises an oscillator circuit 141 and a CPU 142. The oscillator circuit 141 generates a drive signal that has a predetermined frequency equal. The drive signal turns on or off the transistor 126.

The CPU 142 controls the oscillation frequency (i.e., the frequency of the drive signal) of the oscillator circuit 141. It also controls the drive unit 160 that controls the heating roller 101. The CPU 142 has the following means (1) and (2) for controlling excitation frequencies:

(1) Control means for exciting the first serial resonant circuit, sequentially (or alternately) at different frequencies (e.g., f1−Δf) and (f1+Δf) that are nearly equal to the resonance frequency f1, if the P1/P2 switching signal supplied from the print CPU 90 selects the first serial resonant circuit (that is, if only the coil 111*a* is used) because the heating roller 101 needs to generate heat and the pressing roller 102 need not to generate heat to fix monochromic toner images.

(2) Control means for exciting the first serial resonant circuit, sequentially at different frequencies (e.g., f1−Δf) and (f1+Δf) that are nearly equal to the resonance frequency f1, and for exciting the second serial resonant circuit, sequentially at different frequencies (e.g., f2−Δf) and (f2+Δf) that are nearly equal to the resonance frequency f2, if the P1/P2 switching signal supplied from the print CPU 90 selects the first and second serial resonant circuits (that is, if all coils 111 and 171 are used) because both the heating roller 101 and the pressing roller 102 need to generate heat to fix color toner images.

The third embodiment is identical to the first embodiment in any other respects. How the third embodiment operates will be described below.

The oscillator circuit 141 generates a drive signal that has a frequency equal to (or nearly equal to) the resonance frequency f1 of the first serial resonant circuit. The drive signal turns the transistor 126 on and off, exciting the first serial resonant circuit. As a result, the coil 111 generates a high-frequency magnetic field. The magnetic field induces an eddy current in that part of the heating roller 101, which is middle with respect to the axial direction of the roller 101. Joule heat is generated from the eddy current, in the middle part of the heating roller 101.

The oscillator circuit 141 generates a drive signal that has a frequency equal to (or nearly equal to) the resonance frequency f2 of the second serial resonant circuit. This drive signal turns the transistor 126 on and off, too, exciting the second serial resonant circuit. In this case, the coil 171 generates a high-frequency magnetic field. The first magnetic field induces an eddy current in the pressing roller 102. Thus, Joule heat is generated from the eddy current, in the pressing roller 102.

To fix a color toner image, the first and second serial resonant circuits are both excited, whereby the coils 111 and 171 generate a high-frequency magnetic field each. The magnetic fields induce two eddy currents, the first in the heating roller 101 and the second in the pressing roller 102. Joule heat is generated in the heating roller 101 from the first eddy current. Similarly, Joule heat is generated in the pressing roller 102 from the second eddy current.

More correctly, the oscillator circuit 141 output a drive signal that alternately has two different frequencies (f1−Δf) and (f1+Δf), which are nearly equal to the resonance frequency f1, and also a drive signal that alternately has two different frequencies (f2−Δf) and (f2+Δf), which are nearly equal to the resonance frequency f2.

The first drive signal repeatedly excites the first serial resonant circuit, each time alternately at frequencies (f1−Δf) and (f1+Δf). The second drive signal repeatedly excites the first serial resonant circuit, each time alternately at frequencies (f2−Δf) and (f2+Δf).

The first serial resonant circuit is thus excited, alternately at two frequencies (f1−Δf) and (f1+Δf). The output power P1 of the coil 111 is therefore divided and distributed to two systems. The EMI can therefore be attenuated, not only when the first serial resonant circuit is excited at the frequency (f1−Δf) but also when it is excited at the frequency (f1+Δf).

The second serial resonant circuit is thus excited, alternately at two frequencies (f2−Δf) and (f2+Δf). The output power P2 of the coil 171 is divided and distributed to two systems. The EMI can therefore be attenuated, not only when the first serial resonant circuit is excited at the frequency (f2−Δf) but also when it is excited at the frequency (f2+Δf).

The attenuation of the EMI greatly enhances the usefulness and reliability of the fixing apparatus 100.

To fix a monochromic toner image, only the first serial resonant circuit is excited, and the coil 111 generates a high-frequency magnetic field. This magnetic field induces an eddy current in the heating roller 101. The heating roller 101 generates Joule heat from the eddy current. In this case, the first serial resonant circuit is excited, alternately at the frequencies (f1−Δf) and (f1+Δf).

In the third embodiment, too, a frequency-modulating IC (SSIC: Split Spectrum IC) 145 may be provided on the drive-signal line that connects the oscillator circuit 141 to the transistor 126.

Moreover, a structure of the type employed in the second embodiment to achieve temperature compensation may, of course, be provided in the third embodiment.

The present invention is not limited to the embodiments described above. Various changes and modifications can be made, within the scope and spirit of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing apparatus comprising:

a heating roller;

at least one coil provided in the heating roller and configured to generate a high-frequency magnetic field;

a resonant circuit formed of at least one capacitor and the coil; and a control unit which excites the resonant circuit sequentially at a plurality of frequencies which are nearly equal to a resonance frequency of the resonant circuit.

2. The apparatus according to claim 1, wherein the control unit has an oscillator circuit which generates a drive signal of a predetermined frequency, for driving the resonance circuit, and a CPU which controls an oscillation frequency of the oscillator circuit.

3. The apparatus according to claim 1, further comprising a pressing roller which lies in pressing contact with the heating roller and which rotates together with the heating roller.

4. A fixing apparatus comprising:

a heating roller;

a plurality of coils provided in the heating roller, each configured to generate a high-frequency magnetic field;

a plurality of resonant each of formed of a capacitor and one of the coil; and a control unit which excites each of the resonant circuits sequentially at a plurality of frequencies which are nearly equal to a resonance frequency of the resonant circuits.

5. The apparatus according to claim 4, wherein the control unit has an oscillator circuit which generates a drive signal of a predetermined frequency, for driving each resonance circuit, and a CPU which controls an oscillation frequency of the oscillator circuit.

6. The apparatus according to claim 4, further comprising a pressing roller which lies in pressing contact with the heating roller and which rotates together with the heating roller.

7. The apparatus according to claim 4, further comprising a detecting unit which detects changes in the resonance frequency of each resonant circuit, and a control section which changes each of the excitation frequencies.

8. The apparatus according to claim 7, wherein the detecting unit has a current-detecting circuit which detects a current flowing in each resonant circuit and compares the currents detected by the current-detecting circuit when the control unit excites the resonant circuits, thereby to detect the changes in the resonance frequency of each resonant circuit.

9. A fixing apparatus comprising:

a heating roller;

a plurality of coils provided in the heating roller, each configured to generate high-frequency magnetic fields;

a plurality of resonant circuits, each formed of a capacitor and one of the coils; and control means for exciting each of the resonant circuits sequentially at a plurality of frequencies which are nearly equal to a resonance frequency of the resonant circuits.

10. The apparatus according to claim 9, wherein the control means has an oscillator circuit which generates a drive signal of a predetermined frequency, for driving each resonance circuit, and a CPU which controls an oscillation frequency of the oscillator circuit.

11. The apparatus according to claim 9, further comprising a pressing roller which lies in pressing contact with the heating roller and which rotates together with the heating roller.

12. The apparatus according to claim 9, further comprising detecting means for detecting changes in the resonance frequency of each resonant circuit, and a control section which changes each of the excitation frequencies.

13. The apparatus according to claim 12, wherein the detecting means has a current-detecting circuit which detects a current flowing in each resonant circuit and compares the currents detected by the current-detecting circuit when the control means excites the resonant circuits, thereby to detect the changes in the resonance frequency of each resonant circuit.

14. A fixing apparatus comprising:

a heating roller;

a coil configured to generate a high-frequency magnetic field for induction heating of the heating roller;

at least one resonant circuit formed of at least one capacitor and the coil; and a control unit which excites the resonant circuit sequentially at a plurality of frequencies which are nearly equal to a resonance frequency of the resonant circuit.

15. The apparatus according to claim 14, wherein the at least one resonant circuit is a plurality of resonant circuits; and the control unit has an oscillator circuit, which generates a drive signal of a predetermined frequency for driving each resonance circuit, and a CPU that controls an oscillation frequency of the oscillator circuit.

16. The apparatus according to claim 14, wherein the at least one resonant circuit is a plurality of resonant circuits, and the apparatus further comprises a pressing roller which lies in pressing contact with the heating roller and which rotates together with the heating roller.

17. The apparatus according to claim 14, wherein the at least one resonant circuit is a plurality of resonant circuits, and the apparatus further comprises a detecting unit, which detects changes in the resonance frequency of each resonant circuit, and a control section that changes each of the excitation frequencies.

18. The apparatus according to claim 17, wherein the detecting unit has a current-detecting circuit, which detects a current flowing in each resonant circuit and compares the currents detected by the current-detecting circuit when the control unit excites the resonant circuits, thereby to detect the changes in the resonance frequency of each resonant circuit.

* * * * *